US005686007A

United States Patent [19]

Jang

[11] Patent Number: 5,686,007

[45] Date of Patent: Nov. 11, 1997

[54] MICROWAVE OVEN MAGNETRON WITH SLIT FILAMENT TERMINAL

[75] Inventor: Yong Ki Jang, Kyungpuk, Rep. of Korea

[73] Assignee: L.G. Electronics Inc., Seoul, Rep. of Korea

[21] Appl. No.: 518,898

[22] Filed: Aug. 29, 1995

[30] Foreign Application Priority Data

Aug. 29, 1994 [KR] Rep. of Korea ..... 1994-21432

[51] Int. Cl.[6] ..... H05B 6/64; H01J 25/50

[52] U.S. Cl. ..... 219/761; 219/738; 313/313; 315/39.51; 315/85

[58] Field of Search ..... 219/761, 736, 219/738, 742; 313/313; 315/39.51, 39.71, 85; 174/35 R

[56] References Cited

U.S. PATENT DOCUMENTS

| | | | |
|---|---|---|---|
| 4,313,044 | 1/1982 | Staats | 219/742 |
| 4,700,034 | 10/1987 | Lee | 219/742 |
| 4,742,272 | 5/1988 | Kusano et al. | 315/39.71 |
| 5,021,713 | 6/1991 | Uesawa et al. | 315/39.51 |
| 5,280,218 | 1/1994 | Smith | 315/39.3 |
| 5,313,139 | 5/1994 | Yoon | 315/39.51 |
| 5,406,167 | 4/1995 | Choi | 313/313 |

*Primary Examiner*—Philip H. Leung
*Attorney, Agent, or Firm*—Bell, Boyd & Lloyd

[57] ABSTRACT

This invention relates to a magnetron of a microwave oven is disclosed including a lead for supporting a filament, and a filament terminal for electrically connecting the lead and a choke coil, wherein the filament terminal has a slit and serves to cut off unnecessary high harmonic leaked out to an input of the magnetron.

1 Claim, 2 Drawing Sheets

MICROWAVE OVEN MAGNETRON WITH SLIT FILAMENT TERMINAL

FIELD OF THE INVENTION

The present invention relates to a magnetron of a microwave oven, and more particularly, to a magnetron of a microwave oven, whose filament terminal is shaped to serve as a choke, to thereby reduce unnecessary higher harmonics leaked out to the input terminal.

BACKGROUND OF THE INVENTION

Generally, a choke coil assembly, consisting of a choke coil made of enamel line, and a ferrite core, is connected to the input terminal of a magnetron, to countervail unnecessary higher harmonics leaked out to the input.

In a magnetron of a microwave oven, as shown in FIG. 1, thermal electrons generated from a filament 2 are emitted to an action space 4 placed between the ends of a plurality of vanes 3 formed on the inner surface of an anode cylinder 1 and filament 2, generating microwaves from a magnetic circuit composed of an electric field, magnets 5 and 6, upper plate 7, lower plate 8, and magnetic pole 9. An antenna cap 13 of antenna 10 for externally radiating the microwaves, and a radiating plate 14 are externally connected to the anode. To cut off higher harmonics leaked out to the input, a filter circuit consists of choke coil assembly 15, high-voltage through-type condenser 16 and filter cases 17 and 18 for insulating the assembly and condenser. A center-lead 19 and side-lead 20 for supporting filament 2 are inserted into a through-hole of F-ceramic 21, an insulator, and connected with filament-terminal 22.

A conventional filament-terminal 22, as shown FIG. 2, is composed of a plane A brazed to filament-ceramic 21 of FIG. 1, and a bent portion to which choke coil assembly 15 is coupled.

In such a conventional magnetron having the above mentioned structure, energy of higher harmonics component produced from the anode is externally emitted through antenna 10. However, part of the higher harmonics component generated from the anode is, conversely, leaked out to the input through filament 2, center-lead 19 and side-lead 20 for supporting the filament. This unnecessary higher harmonics component is cut off by choke coil assembly 15 connected with center-lead 19 and side-lead 20 by welding, through-type condenser 16 connected to the assembly, and filter cases 17 and 18 surrounding the assembly and condenser. Here, plane A of the F-terminal is brazing-connected to the metallizing plane formed on the lower part of the F-ceramic to air-tight-couple center-lead 19 and side-lead 20 to filament-ceramic 21 in vacuum. The end of the bent portion is connected with choke coil assembly 15, allowing the input power to be transmitted to the filament. However, the filament-terminal does not serve as a choke for countervailing the unnecessary higher harmonics leaked out to the input. The unnecessary high frequency includes fundamental frequency, low band- and high band-frequencies.

When part of the unnecessary higher harmonics from the magnetron is countervailed while passing through the choke coil, heat is generated. If there is a lot of amount of higher harmonics leaked, heat is generated too much, burning the enamel line. Remaining unnecessary higher harmonics not countervailed in the above process is leaked out.

SUMMARY OF THE INVENTION

It is an object is to provide a magnetron having an filament-terminal which has a slit to serve as a choke, reducing the amount of unnecessary higher harmonics and thereby preventing a choke coil from being damaged.

To accomplish the object of the present invention, there is provided a magnetron of a microwave oven including a lead for supporting a filament, and an filament-terminal for electrically connecting the lead and a choke coil, wherein the F-terminal has a slit and serves to cut off unnecessary high harmonics leaked out to an input of the magnetron.

DETAILED DESCRIPTION OF THE INVENTION

Preferred embodiments of the present invention will be explained below with reference to the accompanying drawings.

Figure 1:
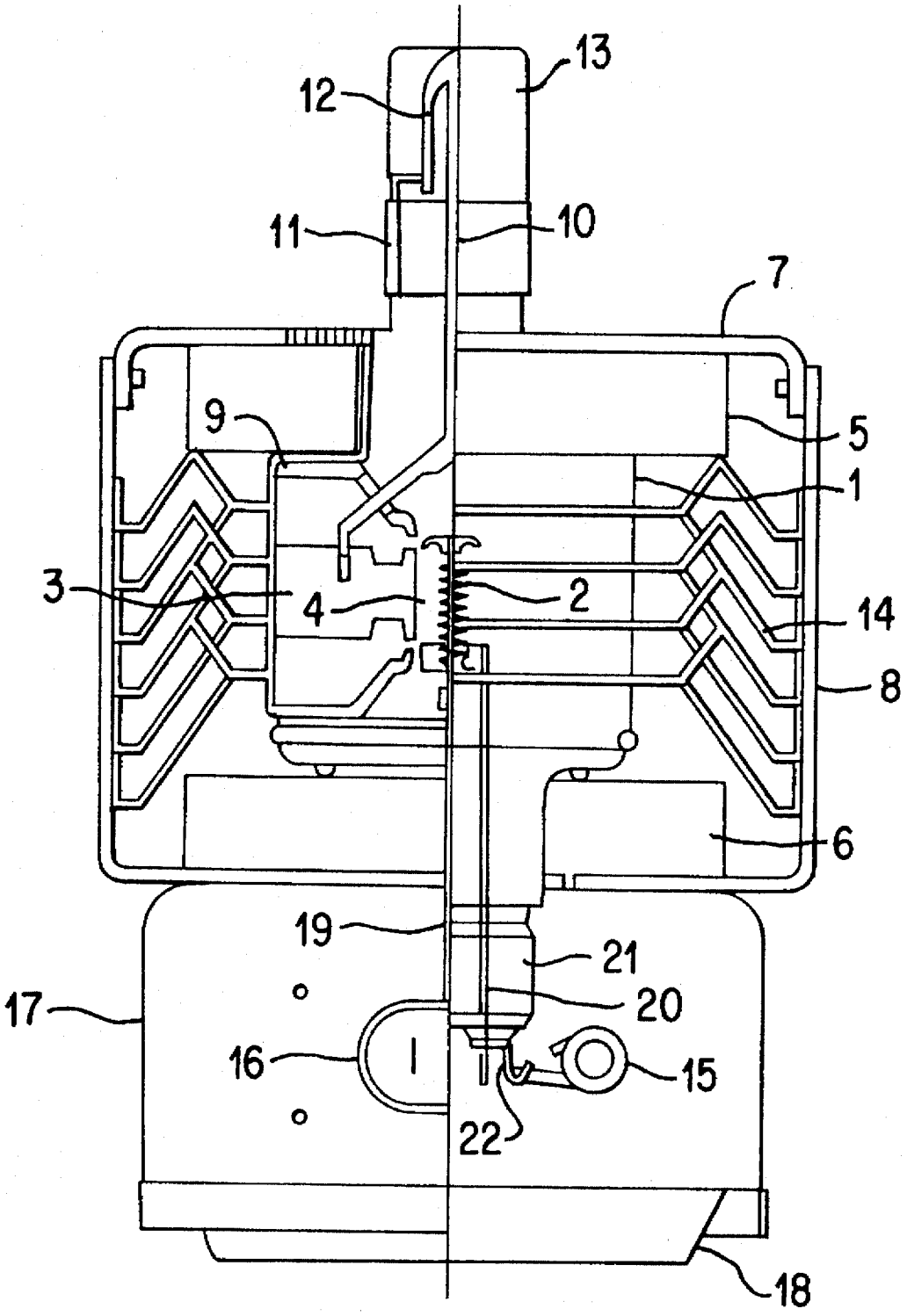
FIG. 1 PRIOR ART
FIG. 1 shows an internal configuration of a conventional magnetron.
Figure 2:
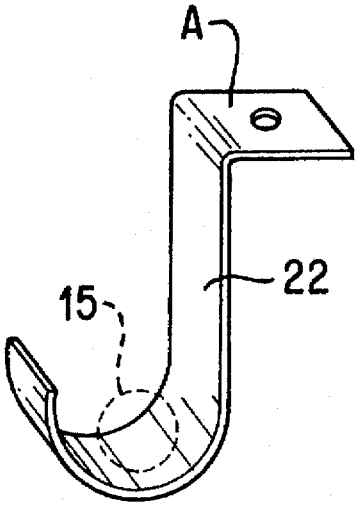
FIG. 2 PRIOR ART
FIG. 2 is a perspective view of a conventional filament-terminal.
Figure 3A:
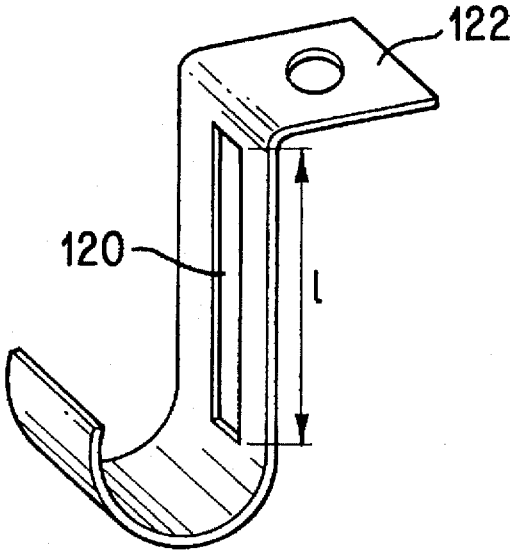
FIGS. 3A to 3C are perspective views of embodiments of the filament-terminal of the present invention.

Referring to FIG. 1, thermal electrons generated from a filament 2 are emitted to an action space 4 placed between the ends of a plurality of vanes 3 formed on the inner surface of an anode cylinder 1 and filament 2, generating microwaves from a magnetic circuit composed of an electric field, magnets 5 and 6, upper plate 7, lower plate 8, and magnetic pole 9. An antenna cap 13 of antenna 10 for externally radiating the microwaves, and a radiating plate 14 are externally connected to the anode. To cut off high harmonics leaked out to the input, a filter circuit consists of choke coil assembly 15, high-voltage through-type condenser 16 and filter cases 17 and 18 for insulating the assembly and condenser. A center-lead 19 and side-lead 20 for supporting filament 2 are inserted into a through-hole of filament-ceramic 21, an insulator, and connected with filament-terminal 22. Referring to FIG. 3A, the overall length of a slit 120 is one fourth the wavelength type of higher harmonics so that filament-terminal 122 serves as a choke for cutting off unnecessary higher harmonics.

Figure 3B:
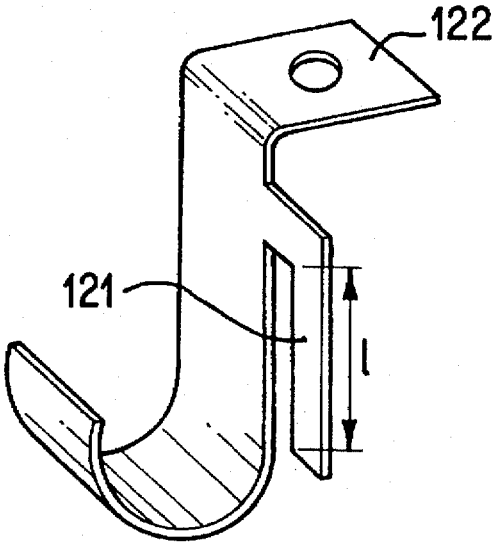

According to another embodiment of the present invention, the filament-terminal has a wing 21 with a slit, as shown in FIG. 3B.

In such a configuration, filament-terminal 122 serves to connect a molybdenum lead with choke coil assembly 15, and acts as a choke for suppressing the unnecessary higher harmoincs. This prevents the choke coil from being burned. The filament-terminal suppresses the unnecessary higher harmonics together with the choke coil assembly, increasing the amount of unnecessary higher harmonics suppressed. This provides a reliable, good-quality magnetron.

Figure 3C:
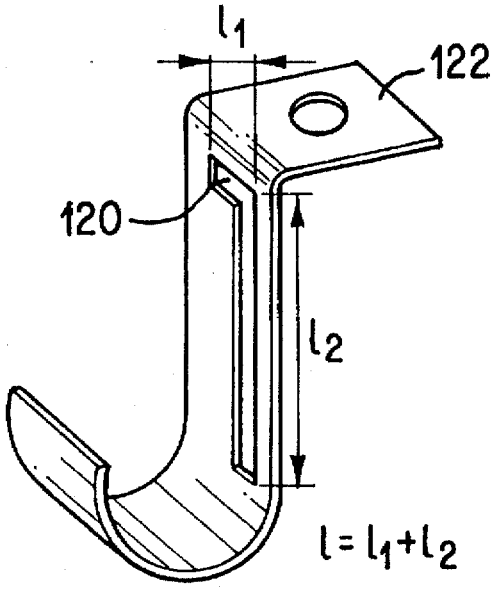

According to still another embodiment of the present invention, as shown in FIG. 3C, higher harmonics components supposed to be suppressed can be interrupted by forming a wing having a slit 120 on the side of filament-terminal 122.

According to the present invention, because the filament terminal functions as a choke, the amount of unnecessary higher harmonics leaked out to the input can be reduced. This prevents the choke coil from being damaged. In addition, the area of the filament-terminal is expanded, promoting the cooling effect against the heat generated from the input.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A magnetron of a microwave oven, comprising a lead for supporting a filament, and an filament-terminal for electrically connecting said lead and a choke coil, wherein said filament-terminal has a slit which is constructed and arranged to suppress unnecessary higher harmonic leaked out to an input of said magnetron;

wherein said filament-terminal comprises a wing having said slit; and wherein the overall length of said slit is one fourth the wavelength of a higher harmonic required to be suppressed.

* * * * *